US007300186B2

(12) United States Patent
Cuypers et al.

(10) Patent No.: US 7,300,186 B2
(45) Date of Patent: Nov. 27, 2007

(54) BLISTER LIGHTS USED FOR SIGNALLING AND/OR MARKING PURPOSES

(75) Inventors: Jan Cuypers, Brüssel (BE); Jean-Claude Vandevoorde, Steenkokkerzeel (BE)

(73) Assignee: Siemens Aktiengesellschaft, Munich (DE)

( * ) Notice: Subject to any disclaimer, the term of this patent is extended or adjusted under 35 U.S.C. 154(b) by 732 days.

(21) Appl. No.: 10/468,600

(22) PCT Filed: Feb. 19, 2002

(86) PCT No.: PCT/DE02/00597

§ 371 (c)(1),
(2), (4) Date: Feb. 4, 2004

(87) PCT Pub. No.: WO02/066888

PCT Pub. Date: Aug. 29, 2002

(65) Prior Publication Data

US 2006/0072312 A1 Apr. 6, 2006

(30) Foreign Application Priority Data

Feb. 20, 2001 (DE) ..... 101 08 144
Oct. 5, 2001 (DE) ..... 101 49 263

(51) Int. Cl.
*F21V 17/00* (2006.01)

(52) U.S. Cl. ..... 362/364; 362/153.1

(58) Field of Classification Search ..... 362/362, 362/364, 365, 326, 294, 373, 374–375, 153.1
See application file for complete search history.

(56) References Cited

U.S. PATENT DOCUMENTS 3,155,321 A 11/1964 Mcdonald
4,358,708 A * 11/1982 Silva et al. ..... 315/58
4,912,610 A * 3/1990 Dahlberg ..... 362/153.1
6,565,239 B2 * 5/2003 Rizkin et al. ..... 362/373
6,902,291 B2 * 6/2005 Rizkin et al. ..... 362/153.1

FOREIGN PATENT DOCUMENTS

| | | |
|---|---|---|
| DE | 94 20 961 U1 | 6/1996 |
| DE | 198 09 253 A1 | 9/1999 |
| DE | 198 37 224 A1 | 3/2000 |
| WO | WO8800315 | 1/1988 |
| WO | WO 97/44612 | 11/1997 |
| WO | WO0146013 | 6/2001 |

* cited by examiner

*Primary Examiner*—Ali Alavi
(74) *Attorney, Agent, or Firm*—Harness, Dickey & Pierce, PLC

(57) ABSTRACT

Blister lights are used for signaling and/or marking purposes. The blister lights include a housing which is embedded in a traffic area, e.g. a street, an airport runway for taking off and for landing, or the like. It further includes a housing cover by which means the housing embedded in the traffic area can be closed on its upper side, the cover being detachably connected to the housing and including at least one light outlet. It additionally includes an illuminating element which is arranged in the housing and by which the light can radiate through the light outlet of the housing cover. In order to enable the illuminating element to have higher current densities and thus to enable the blister lights to have a higher light output capacity, a thermoconducting bridge is formed between illuminating element and the housing cover. By this, the thermal energy produced by the illuminating element can be conducted to the housing cover From these, the thermal energy is guided to the traffic area via the housing which is embedded therein.

10 Claims, 7 Drawing Sheets

BLISTER LIGHTS USED FOR SIGNALLING AND/OR MARKING PURPOSES

This application is the national phase under 35 U.S.C. § 371 of PCT International Application No. PCT/DE02/00597 which has an International filing date of Feb. 19, 2002, which designated the United States of America and which claims priority on German Patent Application numbers DE 101 08 144.8 and 101 49 263.4, respectively filed Feb. 20, 2001 and Oct. 5, 2001, the entire contents of which are hereby incorporated herein by reference.

FIELD OF THE INVENTION

The invention generally relates to a blister light used for signaling and/or marking purposes. Preferably, it relates to one including a housing that is embedded in a traffic area, for example a road, an airport taxiway, an airport runway or the like; and a housing cover by which the housing embedded in the traffic area can be closed at its upper side. The cover may be detachably connected to the housing and may have at least one light exit opening. The light preferably includes a luminous device that is arranged in the housing and by which light can be emitted through the light exit opening in the housing cover.

BACKGROUND OF THE INVENTION

In known blister lights, in which use is also made as luminous device of, inter alia, LEDs (light-emitting diodes), the quantity of heat produced during operation of the luminous device is usually transferred by convection into a gas, which is often air. In some known blister lights, the luminous device is assigned a heat sink starting from which the quantity of heat produced during operation of the luminous device is given off to the gas or air by convection. Because of the limited spatial conditions prevailing in blister lights, even blister lights equipped with a heat sink with low heat transfer resistance have a total heat transfer resistance of usually more than 30 K/W power loss.

In the use, known from the prior art, of LEDs mounted on PC plates, a heat transfer resistance of more than 150 K/W results between the barrier layer of the LEDs and the PC plate. In some automotive applications, a heat transfer resistance of the order of approximately 70 K/W is achieved. These high heat transfer resistances, which accompany maximum temperatures of the barrier layers that are usually of the order of magnitude of a little above 120° C., limit the current density possible and/or permissible during operation of the blister light. They thus produce, in a corresponding way, a limitation of the light-emitting power of the LEDs that can be achieved per unit of area of the barrier layer.

In the case of freely arranged lighting devices, for example traffic lights or the like, this limitation of the emitting power per unit of area is compensated by an increase in the area used for the emission of light and in the number of the light-emitting diodes. This enlargement of the light-emitting area is not practicable for blister lights, since blister lights are embedded in the traffic area. Further, since the emitting area of a blister light that is available in total for the emission of light is limited by the projection of the blister light above the surface of the traffic area, it is necessary for this projection to be as small as possible owing to a multiplicity of technically and mechanically conditioned requirements placed on the blister light.

SUMMARY OF THE INVENTION

It is an object of an embodiment of the invention to provide a blister light, in the case of which the light-emitting power can be increased without increasing the light-emitting area, without exceeding permissible barrier surface temperatures of the luminous device or reducing the service life of the luminous device.

An object may be achieved according to an embodiment of the invention, by virtue of the fact that formed between the luminous device and the housing cover of the blister light is a thermoconducting bridge. By this bridge, thermal energy produced by the luminous device can be conducted to the housing cover. Starting from this, the thermal energy can be dissipated to the traffic area via the housing embedded in the traffic area.

Owing to this configuration of the blister light with a thermoconducting bridge connecting the luminous device to the housing cover or the housing, it is possible to optimize the light output power by using a higher current density in the luminous device. This occurs since the thermal energy occurring can be given off to the traffic area by creating a thermal dissipation path with a low heat transfer resistance, such that the temperatures at the barrier layers of the luminous device remain in the permissible range, and the service life of the luminous means is not reduced.

The capacitance of the traffic area for absorbing thermal energy is virtually unlimited, the traffic area having, moreover, a very large surface for emitting heat. According to an embodiment of the invention, the traffic area is used like a heat sink of unlimited absorptive capacity by virtue of the fact that the barrier layer of the luminous device is connected to the traffic area via the outlined heat dissipation path with a low heat transfer resistance. The heat dissipation from the luminous device, by convection that is substantially less effective by comparison with the outlined heat dissipation path to the traffic area, takes place in the case of the blister light according to an embodiment of the invention only at a negligible order of magnitude.

Owing to the electric current densities prevailing in the case of the inventive configuration of the blister light, it is particularly expedient when power LEDs, also termed high-intensity LEDs, are used as luminous device. The most varied requirements placed on blister lights can be fulfilled by way of such power LEDs, without particular further measures. There is a need, moreover, only for a comparatively limited number of power LEDs. These emit through a transparent emission window that is implemented by the light exit opening present in the housing cover. Owing to the high emitting power of the unit of area of the emitting area that can be realized by means of power LEDs, the requirements placed on blister lights with regard to the emitting power can be fulfilled without the projection of the blister light above the surface of the traffic area being more than 13 mm, smaller projections also being possible.

The required light-emitting powers can be realized in many instances even with a single power LED provided as a luminous device. It is expedient to provide at most six power LEDs per light exit opening as the luminous device.

In order to optimize still further the light output or the light-emitting power of the blister light according to an embodiment of the invention, it is expedient when a collimator element is assigned to the at least one power LED. This collimator element can be used in order to emit the optical radiation directly through the emitting window; alternatively, the light emission can be performed by means of the collimator element after a preceding reflection on a beam-shaping or beam-deflecting mirror. The respectively desired optical radiation distribution can be achieved by the use of collimators, lenses, prisms, deffractors and/or mirrors.

The thermoconducting bridge between the luminous device and the housing cover can be realized in a less complicated way in technical design terms when the at least one power LED is seated with its carrier plate on a base plate that is fitted on at least one cover inner part connected to the underside of the housing cover, and forms with the cover inner part the thermoconducting bridge to the housing cover and thus to the housing.

The thermoconducting bridge is advantageously formed by the base plate and two cover inner parts which are arranged on both sides of the carrier plate and can be connected to the underside of the housing cover.

The two cover inner parts can be arranged on the end sections of the base plate, in which case it is advantageous that each cover inner part bears against the base plate in two dimensions on one side, and against the underside of the housing cover in two dimensions on the other side.

In order to simplify the dissipation of the thermal energy from the at least one power LED to the traffic area, it is expedient when the mutually assigned bearing surfaces on the side of the cover inner part and of the base plate as well as the mutually assigned bearing surfaces on the side of the cover inner part and of the cover are formed in a metallically smooth fashion, so that the heat transfer resistance is as low as possible there.

Of course, the mutually assigned bearing surfaces on the side of the cover and of the housing should correspondingly also be formed in a metallically smooth fashion.

Materials with a high coefficient of thermal conductivity, for example metals, apply in particular as material for the base plate on which the power LED is seated with its carrier plate, for the carrier plate and the cover inner parts.

The thermal energy produced by way of the power LED can be transferred to the traffic area, which serves as a virtually unlimited heat sink, by way of the previously outlined thermoconducting bridge of the blister light according to an embodiment of the invention. The total heat transfer resistance of the barrier layer of the power LED for the base plate is at most approximately 11 K/W; a heat transfer resistance which is less than 1.5 K/W must for this purpose be added for the heat dissipation path from the base plate to the traffic area. Although the maximum light output power is reached at a current of 350 to 1000 mA in the case of the use of power LEDs as the luminous device, the thermal energy produced in the event of the current densities resulting therefrom can be dissipated immediately in the case of the blister light according to an embodiment of the invention.

BRIEF DESCRIPTION OF THE DRAWINGS

The invention is explained in more detail further below with the aid of an embodiment and with reference to the drawings, in which.

DETAILED DESCRIPTION OF THE PREFERRED EMBODIMENTS

Figure 1:
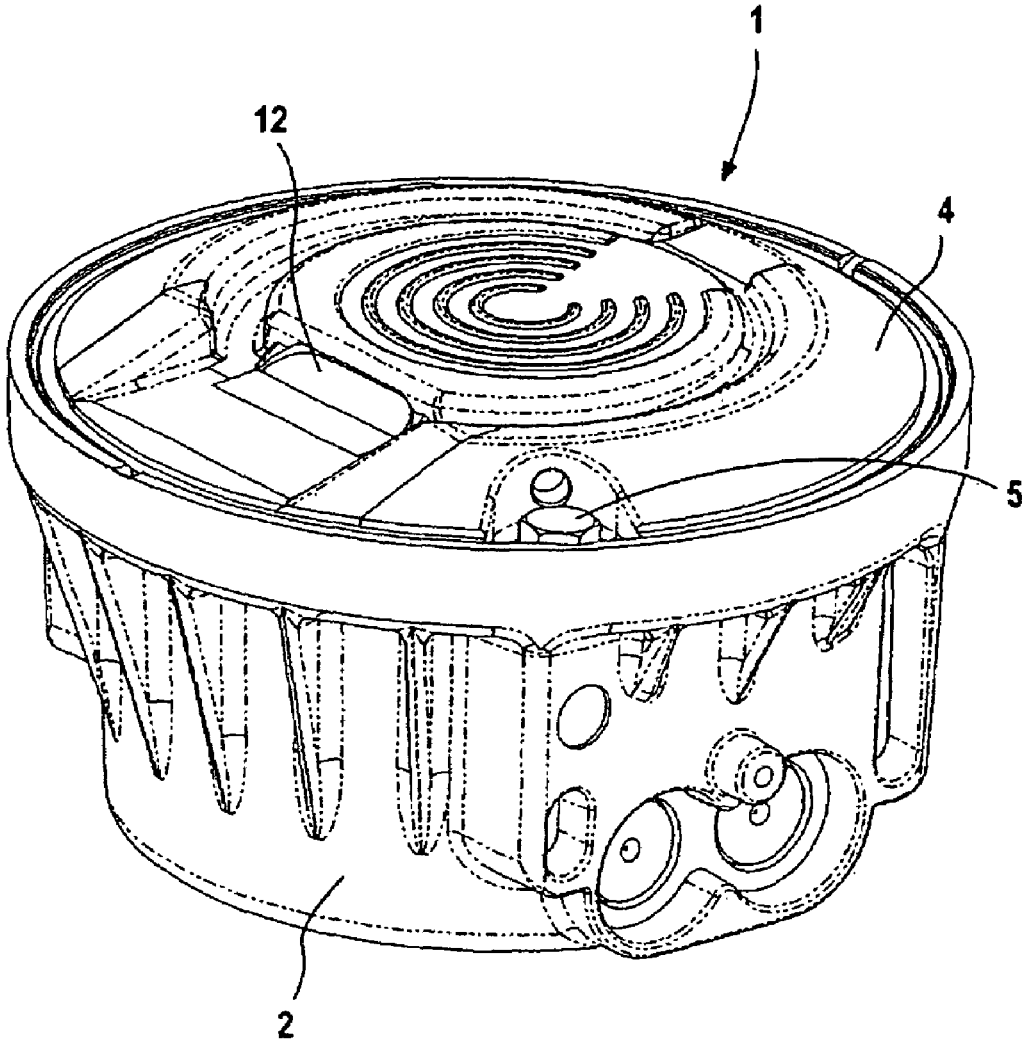
FIG. 1 shows a perspective external view of a blister light according to an embodiment of the invention.

A blister light 1 according to an embodiment of the invention and shown with the aid of FIGS. 1 to 4 has a housing 2 that is of approximately cylindrical construction and is embedded in a traffic area 3.

The traffic area 3 can be, for example, a road, an airport taxiway, an airport runway or the like. The blister light 1 serves for signaling and/or marking purposes.

On its upper side, the housing 2 of the blister light 1 can be closed by way of a housing cover 4 that can be detachably connected to the housing 2, for example by way of screw connections 5. The housing cover 4 projects above the traffic area only slightly, for example by less than 13 mm. The housing 2 is either directly surrounded by the material forming the traffic area 3, or else thermally conducting structural materials such as epoxide- or polyester-filled mortar are provided between the housing 2 and the material forming the actual traffic area 3.

Figure 11:
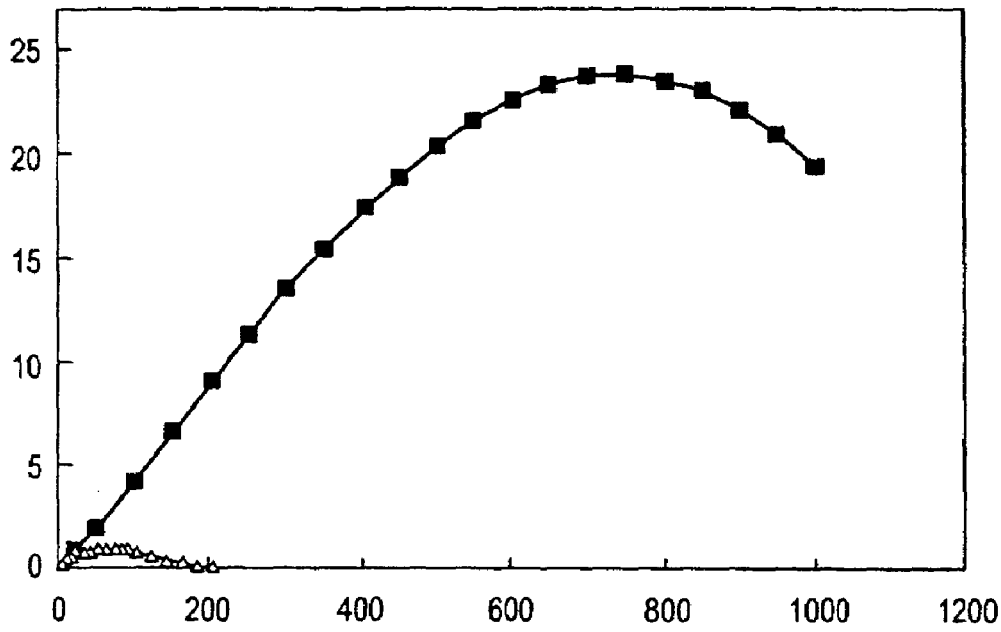
FIG. 11 shows the characteristic of a power LED by comparison with that of a conventional 5 mm LED.

A power LED 6 is provided as luminous device inside the housing 2. As shown in FIG. 11, which shows the light output power as a function of the current intensity for a power LED and for an ordinary 5 mm LED, this power LED 6 has its maximum light output power for a through-current of approximately 700 to 750 mA.

Figure 5:
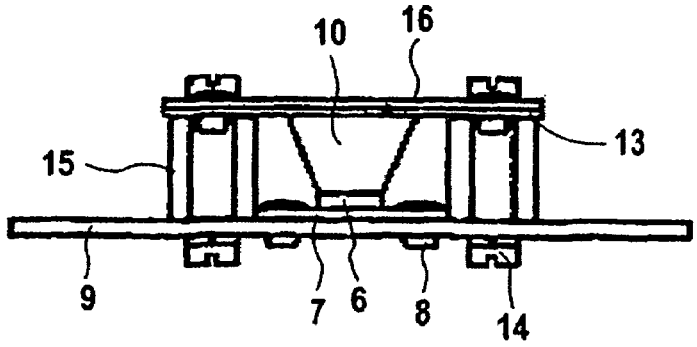
FIG. 5 shows a side view of a luminous device of the blister light according to an embodiment of the invention.

The power LED 6 is seated on a carrier plate 7 that, for its part, is connected to a base plate 9 by suitable connecting device 8, as can best be seen in FIG. 5. The carrier plate 7 of the power LED 6, and the base plate 9, bear against one another in two dimensions. The total heat transfer resistance between the barrier layer of the power LED 6 up to the base plate 9 is approximately 11 K/W. In comparison, the corresponding values of an ordinary 5 mm LED, for which a heat transfer resistance of approximately 220 K/W results, may be gathered from FIG. 11.

The power LED 6 is assigned in the exemplary embodiment shown a collimator element 10 by which the light output of the power LED 6 can be optimized. From the collimator element 10, the light emitted by the power LED 6 reaches an optical unit 11 that the emitted light leaves through a light exit opening 12 provided in the housing cover 4. The configuration of the light beam emitted by the blister light 1 is a function, inter alia, of how the optical unit 11 is, for its part, configured, it being possible for said unit to have lenses, prisms, diffractors, mirrors and the like adapted as appropriate depending on the desired nature of the light emission.

In the region of its radiation exit surface, the collimator element 10 is held via a lens holder 13 that, for its part, is connected by suitable connecting elements 14 to spacers, for example metallic polygonal sleeves 15, which are excellent conductors of heat and project from the base plate 9 on both sides of the carrier plate 7.

Figure 6:
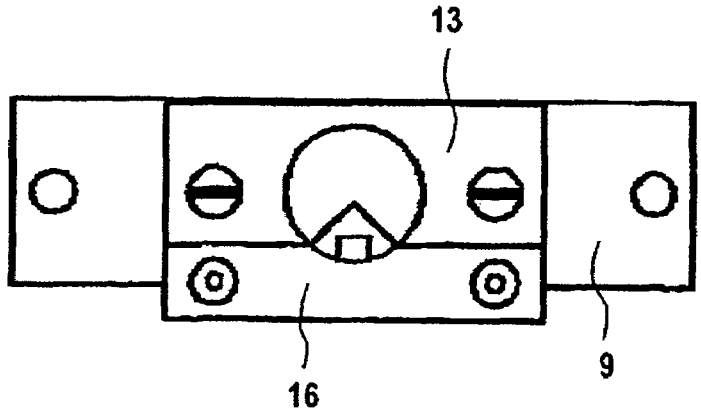
FIG. 6 shows a front view of the luminous device shown in FIG. 5.
Figure 7:
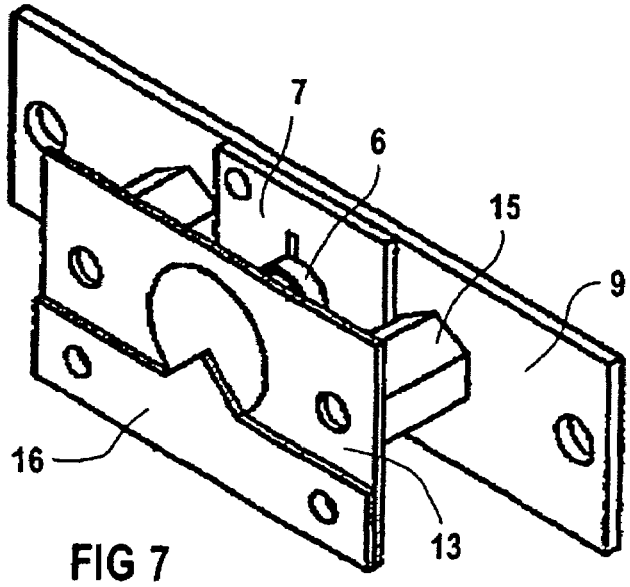
FIG. 7 shows a perspective illustration of the luminous device shown in FIGS. 5 and 6.

A shutter or closure 16 is arranged on the side of the lens holder 13 averted from the collimator element 10. The configuration of the module composed of base plate 9, carrier plate 7, power LED 6, polygonal sleeves 15, collimator element 10, lens holder 13 and shutter or closure 16 may best be seen from FIGS. 5 to 7.

Figure 4:
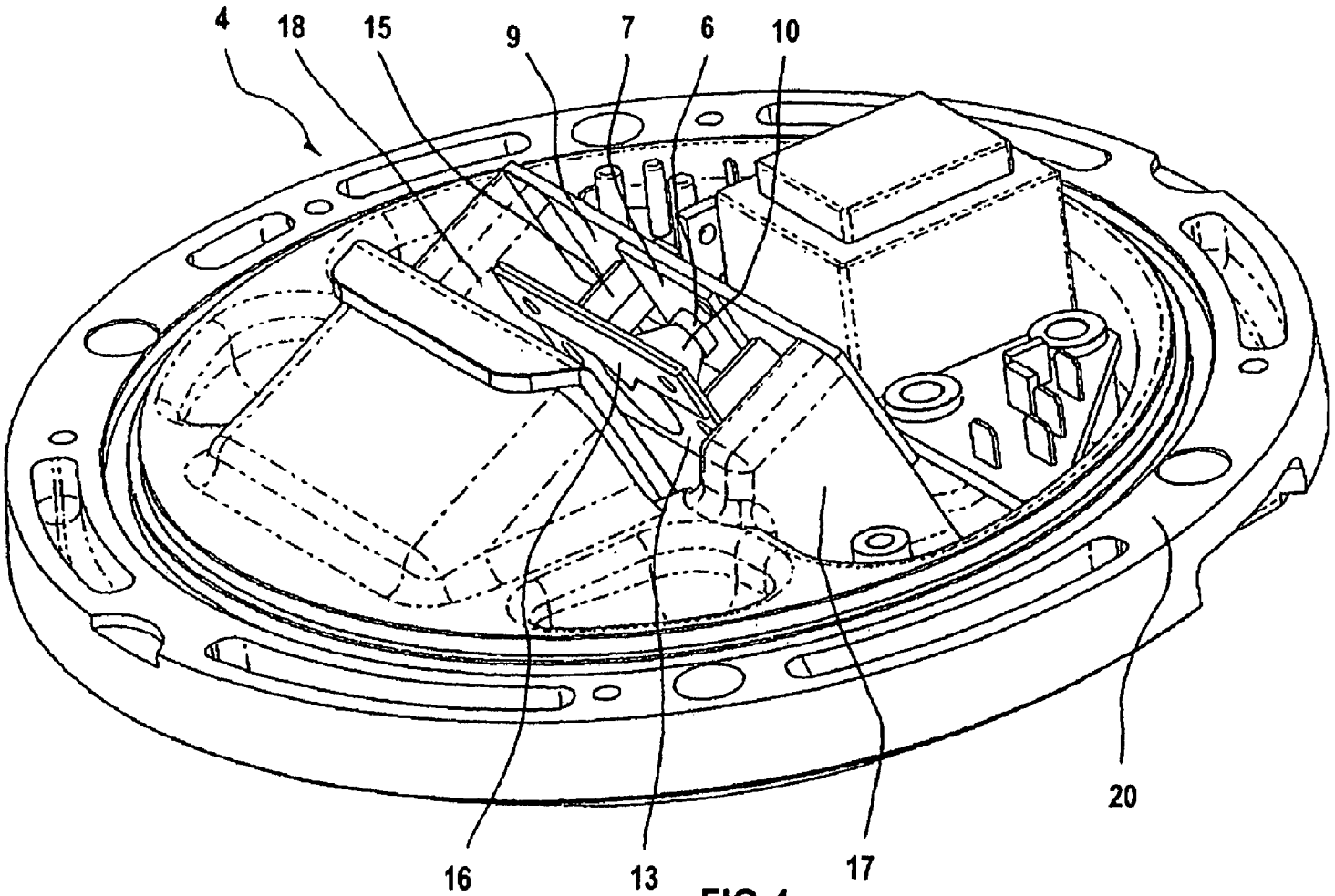
FIG. 4 shows a perspective illustration of the underside of a housing cover of the blister light according to an embodiment of the invention shown in FIGS. 1 to 3.

As follows most effectively from FIG. 4, the base plate 9 is fitted at its two lateral end sections on a respective cover inner part 17, 18. The two cover inner parts 17, 18 are formed in the same way and so only the cover inner part 17 is described below.

Figure 2:
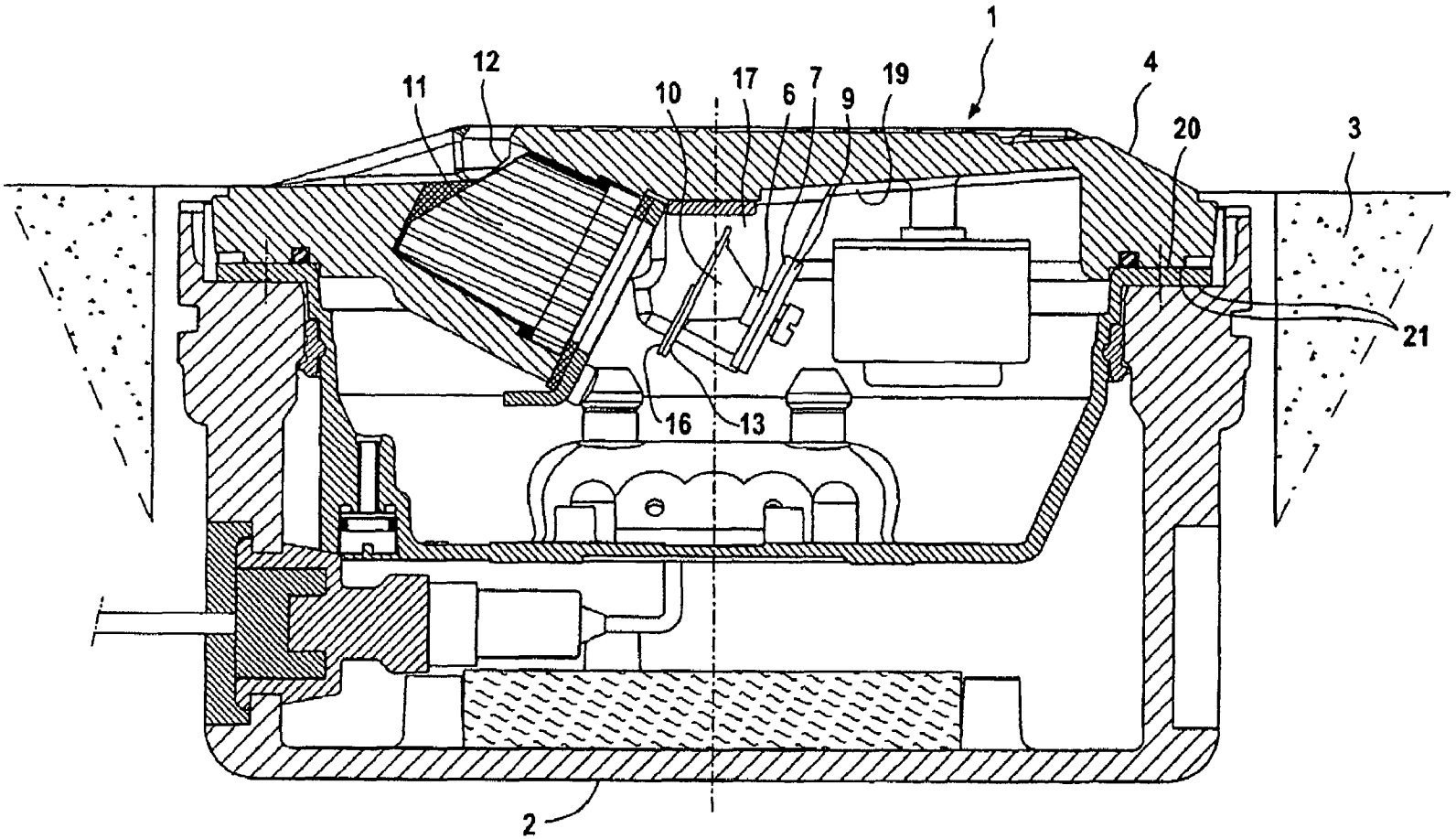
FIG. 2 shows a first sectional illustration of the blister light according to an embodiment of the invention.
Figure 3:
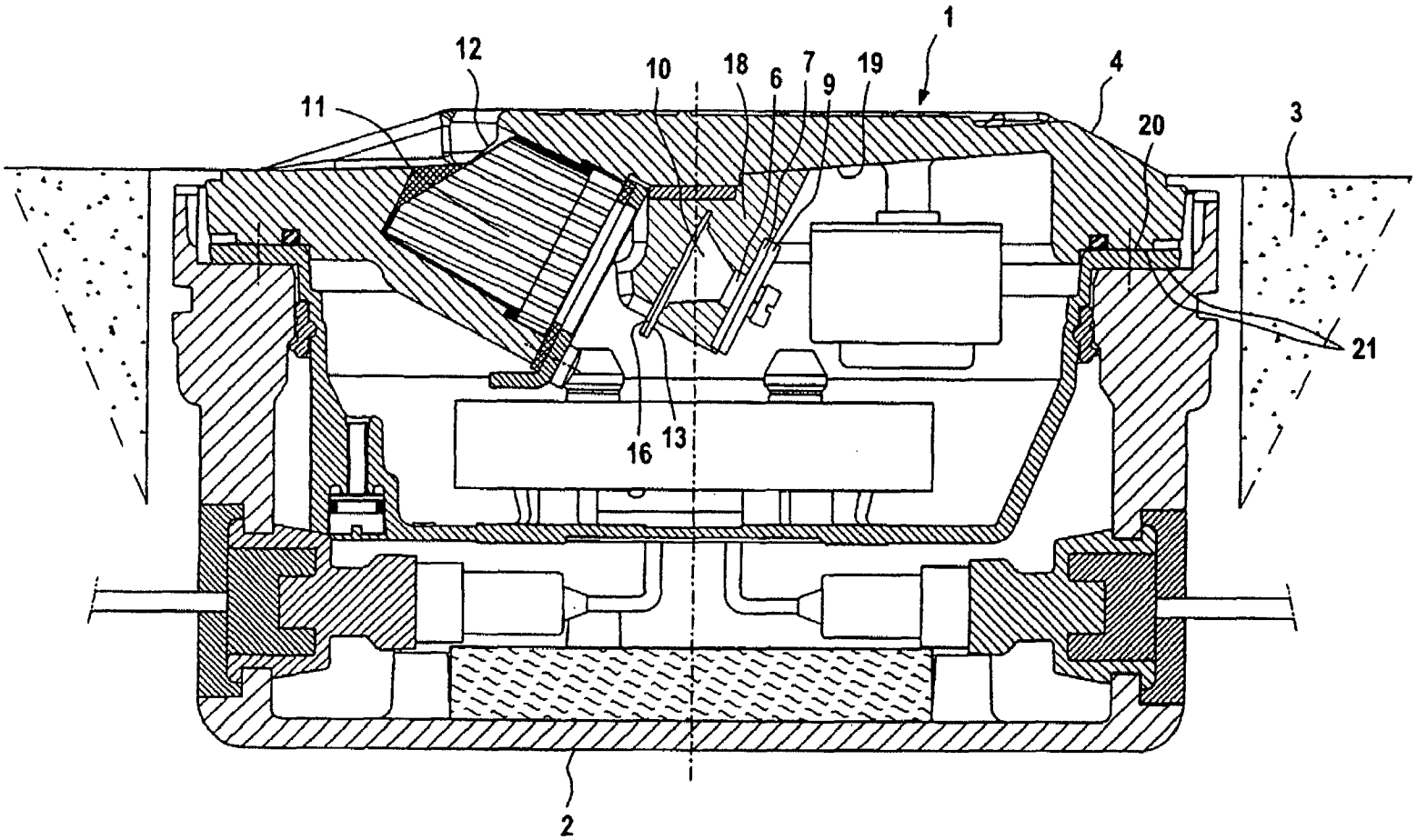
FIG. 3 shows a second sectional illustration of the blister light according to an embodiment of the invention.

As follows best from a combined look at FIGS. 2 to 4, the cover inner part 17 is connected in two dimensions to the underside 19 of the housing cover 4. The cover inner part 17 correspondingly bears in two dimensions on the end section of the base plate 9. The mutually assigned bearing surfaces on the side of the cover inner part and of the base plate as well as the mutually assigned bearing surfaces on the side of the cover inner part and of the cover are formed in a metallically smooth fashion, in order to ensure undisturbed heat transfer between the base plate 9 and the cover inner part 17, or the cover inner part 17 and the housing cover 4.

In the way described above, the base plate 9 and the cover inner part 17 or the cover inner part 18 form a thermoconducting bridge between the power LED or its carrier plate 7 and the housing cover 4.

Via a metallically smooth bearing surface 20 on the cover side, the housing cover 4 is connected, for its part, to a bearing surface 21 on the housing side, which is likewise metallically smooth, the result of this being that the heat is output from the housing cover 4 via the housing 2 to the traffic area or the material forming the traffic area.

Both the carrier plate 7 of the power LED 6, and the base plate 9 and the two cover inner parts 17, 18 are formed from a material with a high coefficient of thermal conductivity such that the thermoconducting bridge, formed by the base plate 9 and the cover inner parts 17, 18, to the housing cover 4. The housing cover 4 and the housing 2 create a heat dissipation path from the power LED 6 up to the traffic area 3. This heat dissipation path has a total heat transfer resistance of approximately 1.5 K/W, the traffic area 3 forming a virtually infinitely large heat sink.

Thus, in the case of the blister light 1 described above, dissipation of heat is effected by the luminous device or by the power LED 6 virtually without convection, it being the case, rather, that a thermoconducting bridge to the housing cover 4 is created by the cover inner parts 17, 18 and the base plate 9. The result is that comparatively large quantities of heat can be output via the housing cover 4 and the housing 2 to the traffic area 3. This renders possible the light output powers of the power LED 6, and thus emitting powers of the blister light 1 that meet any requirements and in the case of which it is plausible nevertheless to comply at once with the restrictions with regard to the dimensioning of the light exit opening 12 that are prescribed by the slight projection of the housing cover 4 above the upper side of the traffic area 3.

Figure 8:
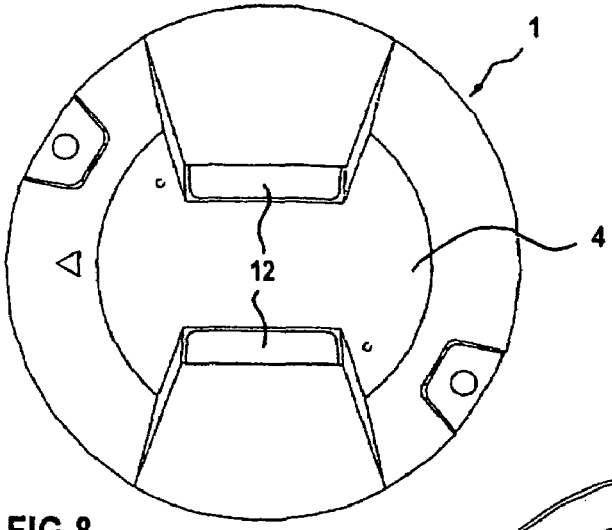
FIGS. 8 to 10 show illustrations of the principle of further blister lights according to and embodiment of the invention.
Figure 10:
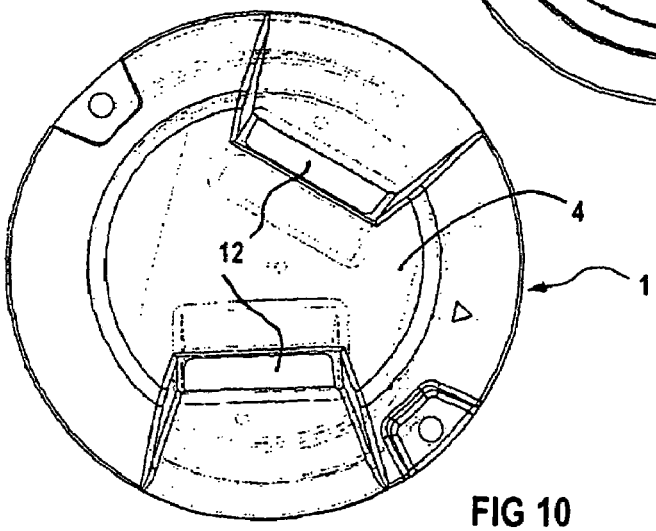

FIGS. 8 and 10 show in plan view further embodiments of blister lights 1 equipped according to the invention with thermoconducting bridges. The embodiment in accordance with FIG. 8 includes a housing cover 4 with two light exit openings 12 arranged symmetrically relative to an axis. The embodiment in accordance with FIG. 10 has a housing cover 4 with two light exit openings 12 whose axes of symmetry enclose an angle.

Figure 9:
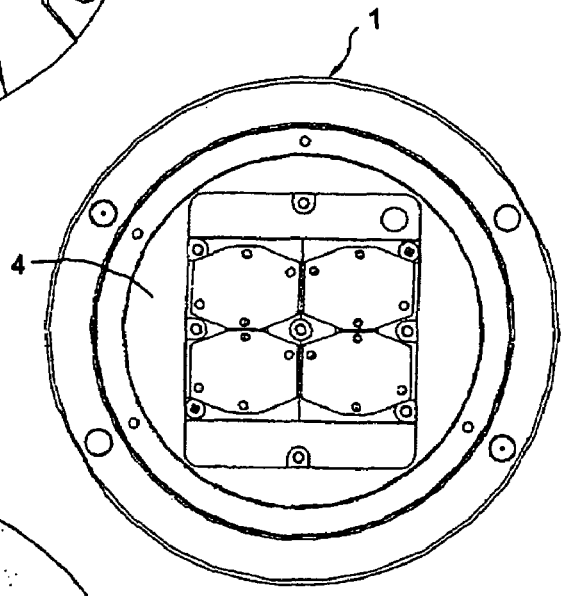

FIG. 9 shows a further embodiment of a blister light 1, formed with thermoconducting bridges according to the invention, with two times four power LEDs.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A blister light, for at least one of signaling and marking purposes, comprising:

a housing, embeddable in a traffic area;

a housing cover, by which the housing is closable at its upper side, the cover being detachably connected to the housing and including at least one light exit opening;

a luminous device, arranged in the housing, adapted to emit light through the light exit opening in the housing cover; and a thermoconducting bridge, formed between the luminous device and the housing cover, adapted to conduct thermal energy produced by the luminous device to the housing cover, wherein the luminous device includes at least one power LED, the at least one power LED is seated with its carrier plate on a base plate fitted on at least one cover inner part connected to an underside of the housing cover, and forms, with said cover inner part, the thermoconducting bridge to the housing, cover, and each cover inner part bears against the base plate in two dimensions on one side, and against the underside of the housing cover in two dimensions on the other side.

2. The blister light as claimed in claim 1, wherein the mutually assigned bearing surfaces on the side of the cover inner part and of the base plate, and the mutually assigned bearing surfaces on the side of the cover inner part and of the cover, are formed in a metallically smooth fashion.

3. The blister light as claimed in claim 1, wherein the mutually assigned bearing surfaces, on the side of the cover and of the housing, are formed in a metallically smooth fashion.

4. The blister light as claimed in claim 1, wherein the luminous device includes at most six power LEDs per light exit opening.

5. The blister light as claimed in claim 4, wherein a collimator element is assigned to the at least one power LED.

6. The blister light as claimed in claim 1, wherein the base plate is formed from a material having a high coefficient of thermal conductivity.

7. The blister light as claimed in claim 1, wherein the carrier plate of the power LED is formed from a material having a high coefficient of thermal conductivity.

8. The blister light as claimed in claim 1, wherein at least one cover inner part is formed from a material having a high coefficient of thermal conductivity.

9. The blister light as claimed in claim 1, wherein the base plate is connected to the underside of the housing cover via two cover inner parts, arranged on both sides of the carrier plate.

10. The blister light as claimed in claim 9, wherein the two cover inner parts are arranged on the end sections of the base plate.

* * * * *